US006715490B2

(12) United States Patent
Byram

(10) Patent No.: US 6,715,490 B2
(45) **Date of Patent: *Apr. 6, 2004**

(54) CONVENIENT "DROP-DOWN" RESPIRATOR

(75) Inventor: David C. Byram, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/391,227

(22) Filed: Mar. 18, 2003

(65) Prior Publication Data

US 2003/0178026 A1 Sep. 25, 2003

Related U.S. Application Data

(63) Continuation of application No. 09/625,794, filed on Jul. 26, 2000, now Pat. No. 6,591,837, which is a division of application No. 08/539,862, filed on Oct. 6, 1995, now Pat. No. 6,119,692, which is a continuation of application No. 08/121,697, filed on Sep. 15, 1993, now Pat. No. 5,464,010.

(51) Int. Cl.[7] ..... A62B 18/08

(52) U.S. Cl. ..... 128/206.27; 128/206.28; 128/207.11

(58) Field of Search ..... 128/206.27, 206.28, 128/207.11

(56) References Cited

U.S. PATENT DOCUMENTS

| | | | |
|---|---|---|---|
| 509,718 | A | 11/1893 | Behrens |
| 671,616 | A | 4/1901 | Thompson |
| 1,055,067 | A | 3/1913 | Molloy |
| 1,398,966 | A | 12/1921 | Hirsh |
| 1,798,576 | A | 3/1931 | Alonso |
| 2,079,581 | A | 5/1937 | Whipple |
| 2,228,379 | A | 1/1941 | Woodward |
| 2,444,417 | A | 7/1948 | Bierman |
| 2,867,812 | A | 1/1959 | Roth et al. |
| 2,928,387 | A | 3/1960 | Layne |
| 2,970,593 | A | 2/1961 | Seeler |
| 3,079,917 | A | 3/1963 | Pate |
| 3,117,574 | A | 1/1964 | Replogle |
| 3,234,939 | A | 2/1966 | Morton |
| 3,234,940 | A | 2/1966 | Morton |
| 3,347,229 | A | 10/1967 | Heitman |
| 3,379,195 | A | 4/1968 | Bleach |
| 3,971,373 | A | 7/1976 | Braun |
| 4,414,973 | A | 11/1983 | Matheson et al. |
| 4,536,440 | A | 8/1985 | Berg |

(List continued on next page.)

FOREIGN PATENT DOCUMENTS

| | | |
|---|---|---|
| CA | 643803 | 6/1962 |
| DE | 818787 | 10/1951 |
| DE | 866108 | 2/1953 |
| DE | 3122034 | 12/1982 |
| JP | 34-12900 | 8/1959 |
| WO | WO 86/01693 | 3/1986 |
| WO | WO 93/14819 | 8/1993 |

*Primary Examiner*—Aaron J. Lewis
(74) *Attorney, Agent, or Firm*—Karl G. Hanson; Allison Johnson

(57) ABSTRACT

A respirator 15 has a harness 10 that allows the respirator body 20 to be conveniently disposed beneath a wearer's chin when not in use. The harness 10 includes a substantially flat, flexible strap 14 and an element 12 that contains a curved elongated slot 16. The substantially flat, flexible strap 14 is threaded through the curved elongated slot 16. The curved configuration of the slot 16 causes the flat flexible strap 14 to be deformed to assume the curved configuration of the slot. This deformation of the strap 14 allows the strap 14 to frictionally engage element 12, and the frictional engagement allows the respirator body 20 to be incrementally withdrawn from the wearer's face so that it can be temporarily stored beneath the wearer's chin, and allows the respirator body 20 to be conveniently repositioned over the nose and mouth of the wearer by simply pulling on free ends 34 of each strap 14 and joining a buckle 32 behind the wearer's neck.

3 Claims, 3 Drawing Sheets

U.S. PATENT DOCUMENTS

| | | | | | |
|---|---|---|---|---|---|
| 4,559,939 | A | | 12/1985 | Levine et al. | |
| 4,676,236 | A | | 6/1987 | Piorkowski et al. | |
| 4,790,306 | A | | 12/1988 | Braun et al. | |
| 4,807,619 | A | | 2/1989 | Dyrud et al. | |
| 4,811,728 | A | | 3/1989 | Von Kopp | |
| 4,827,924 | A | | 5/1989 | Japuntich | |
| 4,960,121 | A | | 10/1990 | Nelson et al. | 128/206.24 |
| 5,033,465 | A | | 7/1991 | Braun et al. | |
| 5,062,421 | A | | 11/1991 | Burns et al. | |
| 5,069,205 | A | | 12/1991 | Urso | 128/201.24 |
| 5,156,146 | A | | 10/1992 | Corces et al. | 128/202.27 |
| 5,181,507 | A | | 1/1993 | Michel et al. | 128/201.25 |
| 5,237,986 | A | | 8/1993 | Seppala et al. | |
| 5,291,880 | A | | 3/1994 | Almovist et al. | 128/201.22 |
| 5,464,010 | A | * | 11/1995 | Byram | 128/207.11 |
| 6,062,221 | A | * | 5/2000 | Brostrom et al. | 128/206.27 |
| 6,095,143 | A | * | 8/2000 | Dyrud et al. | 128/206.27 |
| 6,119,692 | A | * | 9/2000 | Byram | 128/206.27 |
| 6,338,342 | B1 | * | 1/2002 | Fecteau et al. | 128/207.11 |
| 6,457,473 | B1 | * | 10/2002 | Brostrom et al. | 128/207.11 |
| 6,497,232 | B2 | * | 12/2002 | Fecteau et al. | 128/207.11 |
| 6,536,435 | B1 | * | 3/2003 | Fecteau et al. | 128/207.11 |
| 6,591,837 | B1 | * | 7/2003 | Byram | 128/206.24 |

* cited by examiner

CONVENIENT "DROP-DOWN" RESPIRATOR

This application is a continuation of prior application Ser. No. 09/625,794, filed on Jul. 26, 2000 U.S. Pat. No. 6,591,837, which is a division of prior application Ser. No. 08/539,862 filed on Oct. 6, 1995 (now U.S. Pat. No. 6,119, 692), which is a continuation of application Ser. No. 08/121, 697, filed on Sep. 15, 1993 (now U.S. Pat. No. 5,464,010).

TECHNICAL FIELD

This invention pertains to a respirator that can be conveniently disposed beneath a wearer's chin when not in use.

BACKGROUND OF THE INVENTION

There are two important reasons for wearing a respirator: to prevent impurities or contaminants from entering the wearer's breathing track; and to protect others from being exposed to pathogenic microbes and other contaminants exhaled by the wearer. When wearing a respirator for either of these reasons, occasions frequently arise which require the wearer to temporarily displace the body of the respirator from their face. For instance, the wearer may temporarily leave a contaminated area for a short time, or the wearer may wish to briefly speak to another person. When the respirator body is temporarily displaced from the wearer's face, it is desirable to keep the respirator body readily accessible so that it can be quickly retrieved and returned to its position over the wearer's nose and mouth. Otherwise, it becomes more likely that the person would not consistently wear the respirator in the work place, creating unsafe conditions for the wearer or others who may be exposed to contaminants exhaled by the wearer.

SUMMARY OF THE INVENTION

The present invention provides a new respirator which has a harness that allows the respirator body to be retained in a convenient location when removed from a wearer's face. In the respirator of the invention, the harness is attached to the respirator body and includes an element that contains a curved elongated slot and a substantially flat, flexible strap. The substantially flat, flexible strap slidably passes through the curved elongated slot in the element. The curved elongated configuration of the slot deforms the strap, causing the strap to assume the curved configuration of the slot to frictionally engage the element at the point where the strap passes through the curved elongated slot.

The use of such a harness in a respirator is particularly beneficial for temporarily storing the respirator body when not in use and for conveniently remounting the respirator body upon the wearer's face. When a wearer desires to remove the respirator body from their face, the flexible strap can be slid through the curved elongated slot to create slack sufficient to allow the respirator body to be stored beneath the wearer's chin. When the wearer desires to return the respirator body to its position over the wearer's nose and mouth, the wearer simply pulls on the strap, and the respirator body rises up into position over the nose and mouth of the wearer. The frictional engagement between the strap and the element allows the respirator body to remain in that position until a buckle or other suitable means is engaged to more snugly secure the respirator body to the person's face. Thus, the respirator of the invention is advantageous in that: (1) the respirator body can be conveniently disposed beneath the wearer's chin when not in use; and (2) the respirator body can be provisionally supported by itself over the nose and mouth of the wearer until a more permanent securement is achieved. Both of these advantages improve the likelihood that the wearer will consistently wear the respirator in the work place. The former advantage does so by keeping the respirator body readily accessible, and the latter advantage does so by making it easier for the wearer to reposition the respirator body over their nose and mouth.

In addition to the advantages (1) and (2) described above, the invention also is advantageous in that the harness is very simple in design. The harness employs a minimal number of parts, which do not have a complicated structure and are relatively easy to manufacture.

The above and other advantages of the invention are more fully shown and described in the drawings and detailed description of this invention, where like reference numerals are used to represent similar parts. It is to be understood, however, that the description and drawings are for the purposes of illustration only and should not be read in a manner that would unduly limit the scope of this invention.

DETAILED DESCRIPTION OF THE PREFERRED EMBODIMENTS

In describing the preferred embodiments of the invention, specific terminology will be used for the sake of clarity. The invention, however, is not intended to be limited to the specific terms so selected, and it is to be understood that each term so selected includes all the technical equivalents that operate similarly.

Figure 1:
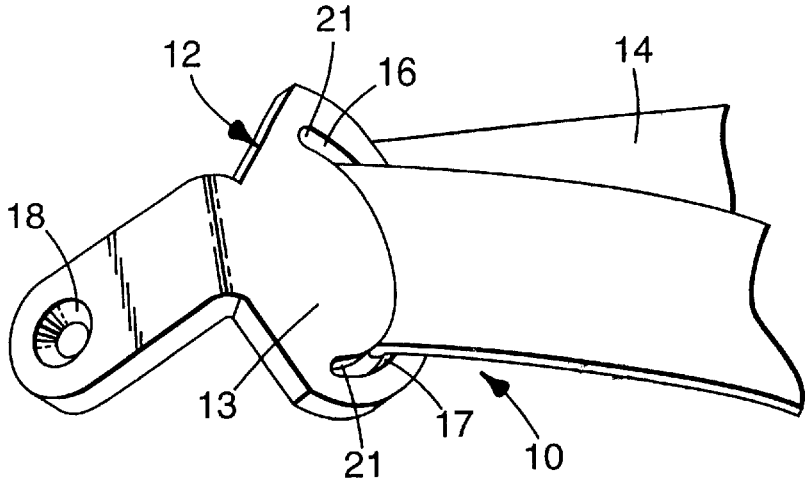
FIG. 1 is an isometric view, partially illustrating a harness 10 in accordance with the present invention.

In the practice of the present invention, a respirator body can be snugly fit to a wearer's head when in use and can be conveniently located in a "drop-down" position beneath the wearer's chin by use of a respirator harness 10 partially illustrated in FIG. 1. Harness 10 includes an element 12, and a strap 14. Element 12 has a portion 13 that possess a curved elongated slot 16 through which strap 14 is slidably disposed. The curved elongated configuration of slot 16 allows strap 14 to frictionally engage element 12. The term "frictionally engage" means there is resistance to sliding the strap 14 through the curved elongated slot. Stated another way, the force needed to move the strap 14 through the curved elongated slot 16 is significantly greater than the force needed to move the strap 14 through the slot 16 absent the frictional engagement. Strap 14 is a substantially flat strap; that is, one dimension is substantially smaller than the other two dimensions. Strap 14 also is flexible so that when threaded through the curved elongated slot 16, the substantially flat flexible strap 14 assumes the slot's curved elongated configuration. Because the substantially flat, flexible strap 14 naturally desires to assume a less tortuous configuration, the strap 14 presses against the sidewall 17 of slot 16 as the strap 14 passes therethrough causing a frictional engagement therewith.

The curved slot 16 in element 12 preferably has a width that is approximately the same as the thickness of flat flexible strap 14. A curved elongated slot 16 with such a thickness, enables a good frictional engagement to occur between element 12 and strap 14. The frictional engagement can be increased by decreasing the radius of the curve of slot 16 or by increasing the thickness or width of the flat flexible strap 14. Flat flexible strap 14 preferably is made from a material that is elastic in the longitudinal direction of the strap so that a snug fit can be achieved on the wearer's face.

Figure 2:
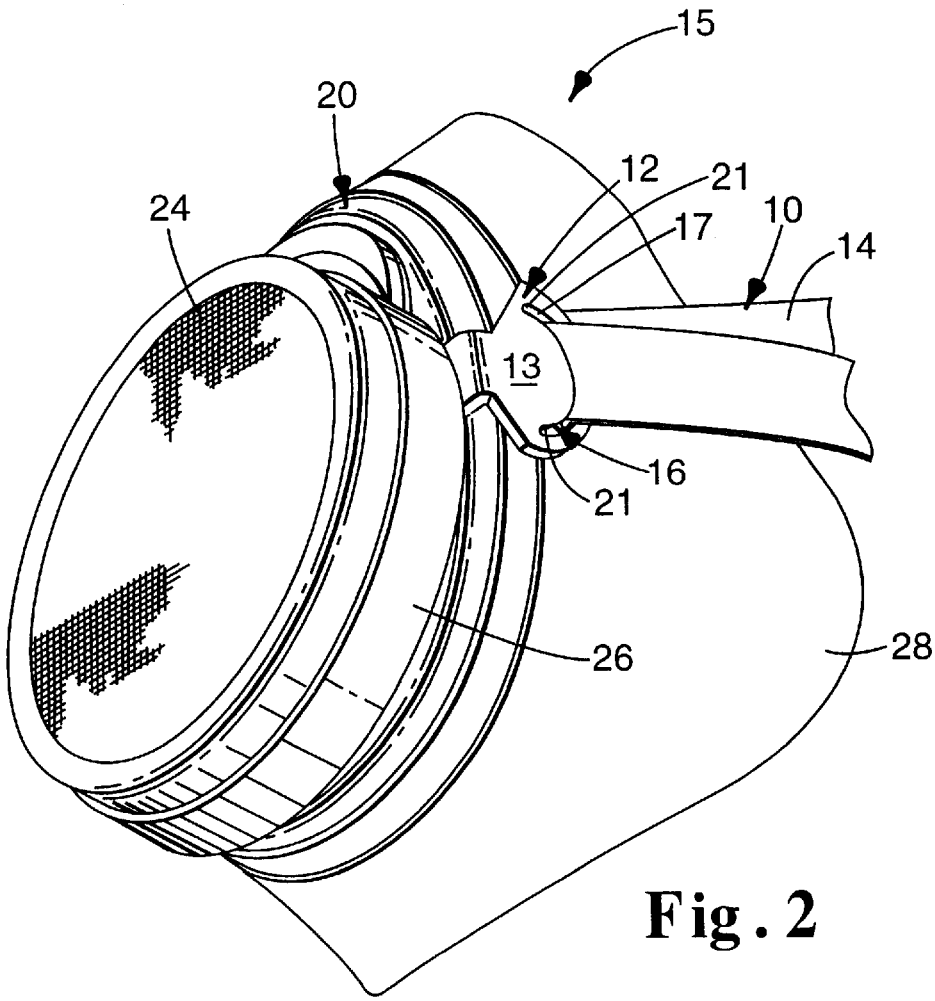
FIG. 2 is an isometric view of a respirator 15 in accordance with the present invention.

Referring to FIG. 2, element 12 may be hinged or otherwise bent so that when mounted to respirator body 20, portion 13 of element 12 is swept back in a direction that points towards the wearer's face (when the respirator body 20 is donned). Curved elongated slot 16 preferably is semi-circular, with the ends 21 of the curved slot 16 pointing away from the wearer's face (when the respirator body 20 is donned). In a typical embodiment, the curved elongated slot 16 has an arc length of about 1 to 4 centimeters (cm) and a thickness of about 0.5 to 5 millimeters (mm), and the strap has a width of about 0.5 to 3 cm and a thickness of about 0.5 to 5 mm. The radius of the curve of elongated slot 16 typically is about 0.5 to 2 cm. Preferably, the radius of the curve of elongated slot 16 is less than the width of the substantially flat flexible strap 14.

Figure 3:
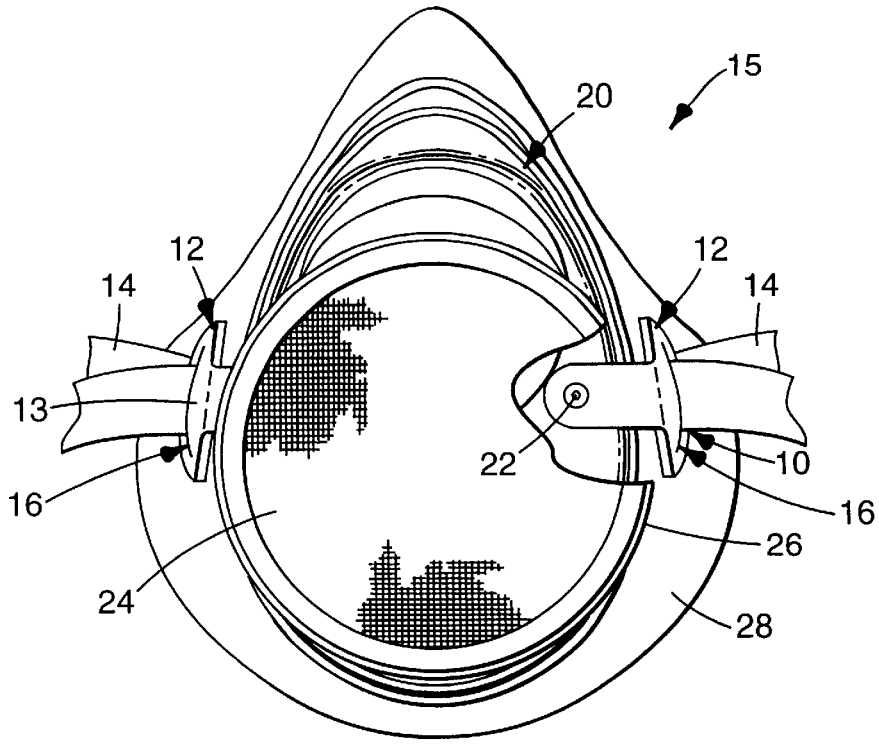
FIG. 3 is a partially broken front view of a respirator 15 in accordance with the present invention.

Element 12 also may possess an opening 18 (FIG. 1) or any other suitable means to allow the element 12 to be attached to the respirator body 20. The use of the term "attached" when referring to element 12 and its relationship to a respirator body is not limited to instances where the element 12 and respirator body 20 are two separate units subsequently joined together as shown in FIG. 3. Rather, the term is defined here to include the situation where the element containing the curved elongated slot 16 simply resides in the respirator body 20 as an integral unit. In such an instance, the member 12 is part of the respirator body 20 and, in accordance with the definition just provided, is "attached to" the respirator body 20.

Referring to FIG. 3, there is shown one way an element 12 can be attached to respirator body 20. A set screw or rivet 22 or the like may be employed to fasten element 12 to a rigid part of the respirator body 20. Alternatively, an adhesive, glue, or weld may be employed. Or, as stated above, the element 12 may be an integral (one-piece) part of the respirator body.

As shown in FIG. 3, the respirator 15 can have two slotted elements 12 through which a strap 14 passes. Strap 14 may be a single strap, or it may be, for example, two individual straps which can be joined together.

Figure 4:
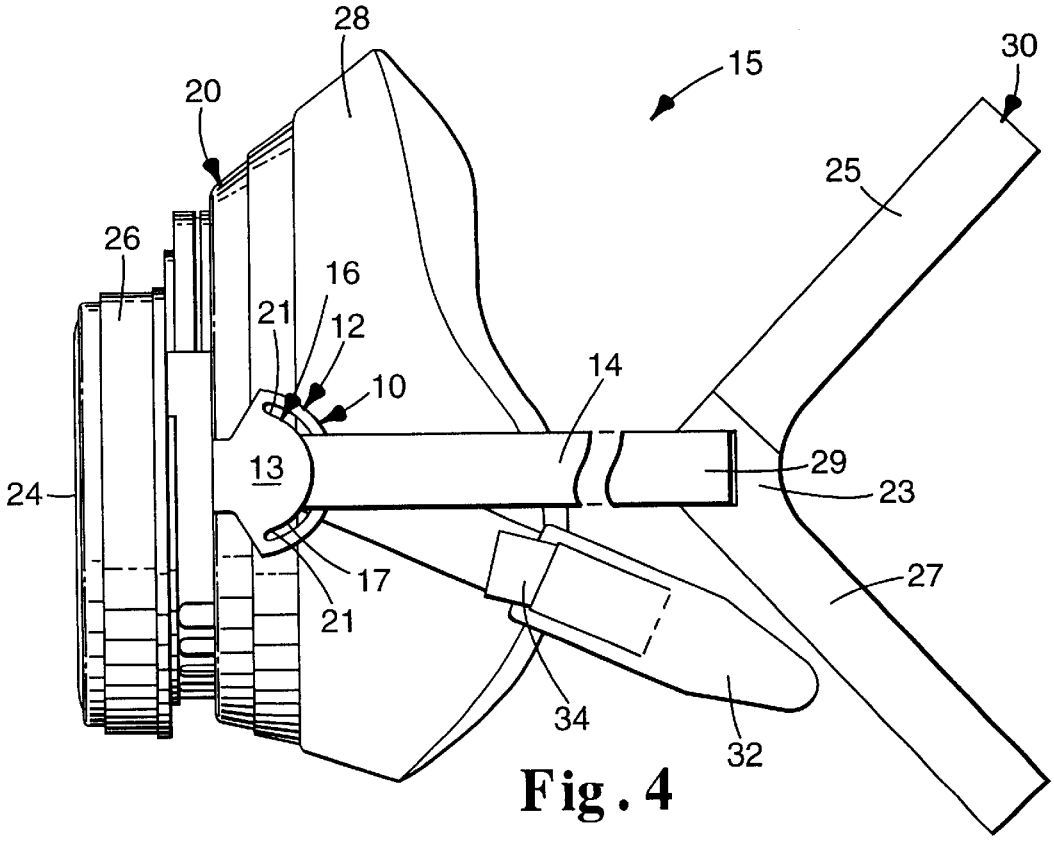
FIG. 4 is a side view of a respirator 15 in accordance with the present invention.

Referring to FIG. 4, the individual straps 14 may be joined together at a first end 29 by crown member 30. Crown member 30 has a shape adapted to rest on a person's cranium. As shown, crown member 30 has two crown straps 25 and 27 spaced apart approximately 90 degrees and joined together at junction portion 23 where crown straps 25 and 27 meet and the first end 29 of each strap 14 is attached to member 30. Crown straps 25 and 27 preferably are pre-curved to fit over and conform to the top and back of a person's head, respectively. At the second or free end 34 of straps 14 there can be provided a fastener or buckle 32 or other suitable means for joining free ends 34 of straps 14 together. The free ends 34 of straps 14 may be passed behind a wearer's neck and joined together by buckle 32 when the mask is disposed over the wearer's nose and mouth.

Figure 5:
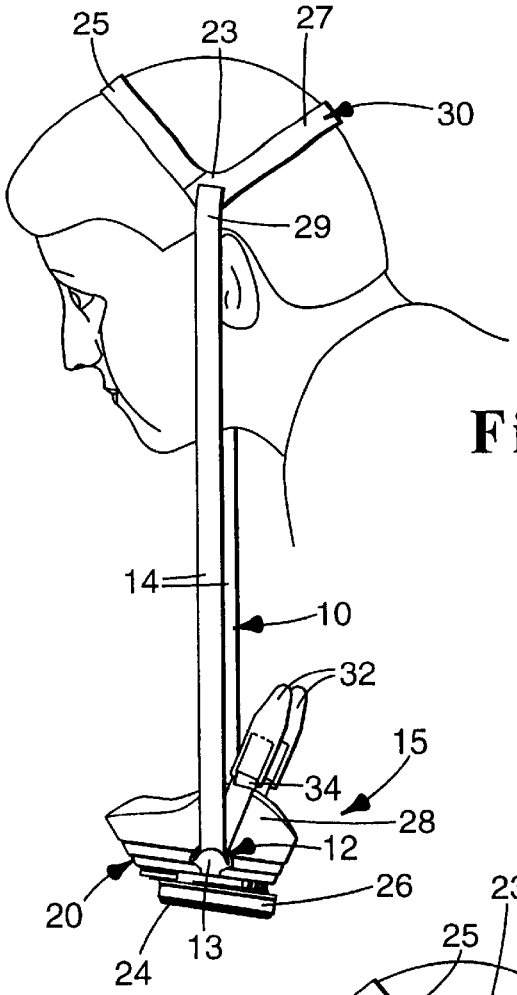
FIG. 5 is a side view of a respirator 15 in accordance with the present invention in a drop-down position on a wearer.

With particular reference to FIG. 5, the respirator body 20 may be temporarily removed from the wearer's face so that it can dangle freely and conveniently beneath the wearer's chin. The temporary off-the-face storage can be achieved by simply disengaging buckle 32 and slightly pulling on the respirator body 20. Frictional engagement of straps 14 to curved elongated slot 16 in each element 12 preferably is great enough to suspend respirator body 20 under its own weight. When the frictional engagement is at least great enough to suspend respirator body 20, the respirator body 20 can be incrementally withdrawn from the wearer's face and may be suspended at any location along straps 14 from the wearer's face to the free ends 34 of straps 14.

Figure 6:
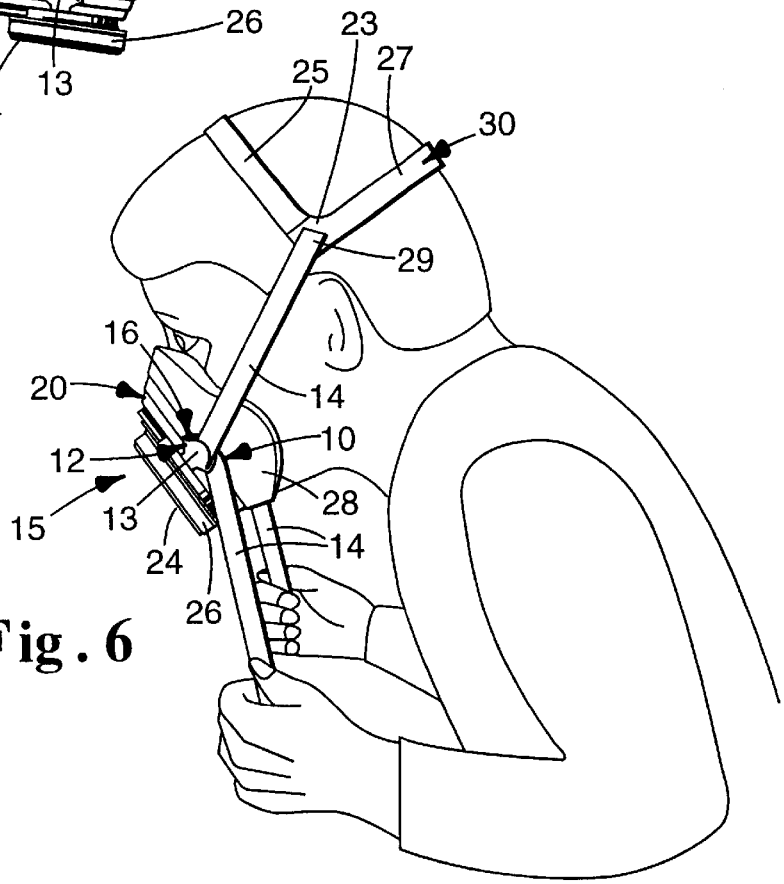
FIG. 6 is a side view of a respirator 15 in accordance with the present invention in position over the wearer's nose and mouth.

A frictional engagement strong enough to suspend respirator body 20 under its own weight also allows the respirator to be conveniently returned to the position shown in FIG. 6. This can be accomplished by pulling on the free ends 34 of each strap 14. When the straps 14 have been drawn through their respective curved elongated slots 16 to such an extent that the respirator body 20 is disposed over the nose and mouth of the wearer, the frictional engagement of the strap 14 with element 12 enables the respirator body 20 to be maintained in that location without continued pulling on straps 14 or holding the respirator body 20 in that position with the wearer's hand. The wearer can have both hands free to engage buckle 32 behind the wearer's neck. Thus, the harness assembly 10 is very convenient, preventing the wearer from becoming aggravated by feeling that three hands are needed to don the respirator 15. The convenience provided by the respirator of the invention makes it more likely that the wearer will consistently wear the respirator in the work place.

Although the respirator body 20 shown in FIGS. 2–6 comprises a filter element 24, a filter element retainer 26, and a soft-compliant face piece 28, the respirator body 20 may take essentially any form, depending on the end use of the respirator. For example, the respirator body 20 may be a light-weight particulate respirator such as shown in U.S. Pat. Nos. 4,536,440, 4,807,619, and 4,827,924; a light weight particulate/vapor respirator such as shown in U.S. Pat. No. 3,971,373; or a relatively heavier vapor respirator such as shown in U.S. Pat. Nos. 4,790,306, 5,033,465, and 5,062,421 (the disclosures of each of the above-cited patents are each incorporated here by reference). And, although the respirator 15 shown in FIGS. 2–6 uses two slotted elements 12 in the harness assembly 10, it may be desirable in heavier respirators to employ more than two slotted elements; for example, four slotted elements may be used, two on each side of the respirator body, to support the respirator on the wearer's face. As another embodiment, the curved elongated slots 16 need not be attached to the respirator body. The slots 16 could be associated with the crown member 30; for example, curved elongated slots could be provided in crown member 30 at junction portion 23 and strap 14 could be threaded through a first curved elongated slot in the crown member, to the respirator body, behind the neck of the wearer, to the respirator body again, and through a second curved elongated slot on the opposite side of the crown member. The two free ends of the strap which extend out of the respective curved slots may be joined by a buckle behind the wearer's head. Accordingly, it should be understood that this invention may take on various modifications and alterations without departing from the spirit and scope thereof. It also should be understood that this invention is not to be limited to the above-described, but is to be controlled by the limitations set forth in the following claims and any equivalents thereof.

What is claimed is:

1. A respirator comprising:

a) a respirator body sized to fit over a nose and mouth; and b) a harness attached to the respirator body, the harness comprising 1) an element that contains a first curved, elongated slot, 2) an element that contains a second curved, elongated slot, 3) a crown member;

4) a first substantially flat flexible strap attached to the crown member, the first substantially flat flexible strap having an end that slidably passes through the first curved elongated slot; and 5) a second substantially flat flexible strap attached to the crown member, the second substantially flat flexible strap having an end that slidably passes through the second curved elongated slot.

2. The respirator of claim 1, further comprising a first buckle component attached to the first substantially flat flexible strap; and a second buckle component attached to the second substantially flat flexible strap.

3. The respirator of claim 1, further comprising a first buckle component attached to the end of the first substantially flat flexible strap that slidably passes through the first curved elongated slot; and a second buckle component attached to the end of the second substantially flat flexible strap that slidably passes through the second curved elongated slot.

* * * * *